US005731059A

United States Patent [19]

Smith et al.

[11] Patent Number: 5,731,059

[45] Date of Patent: Mar. 24, 1998

[54] DRYER FABRIC HAVING AN ABRASION RESISTANT EDGE

[75] Inventors: Richard W. Smith, Greenville; Scott Quigley, Simpsonville, both of S.C.

[73] Assignee: Wangner Systems Corporation, Greenville, S.C.

[21] Appl. No.: 558,742

[22] Filed: Nov. 16, 1995

Related U.S. Application Data

[63] Continuation-in-part of Ser. No. 239,903, May 9, 1994, Pat. No. 5,506,033, which is a continuation-in-part of Ser. No. 43,848, Apr. 7, 1993, abandoned.

[51] Int. Cl.[6] ..... B32B 23/02

[52] U.S. Cl. ..... 428/192; 428/222; 428/227; 428/229; 428/280; 428/282; 428/284; 428/287; 162/141; 162/900; 162/902

[58] Field of Search ..... 428/288, 290, 428/222, 226, 227, 229, 236, 280, 282, 284, 287; 162/358, 348, DIG. 1, 358.2, 900, 902, 903, 141

[56] References Cited

U.S. PATENT DOCUMENTS

| | | | |
|---|---|---|---|
| 4,427,736 | 1/1984 | Beacom et al. | 428/288 |
| 4,500,590 | 2/1985 | Smith | 428/222 |
| 4,528,236 | 7/1985 | Funn et al. | 428/22 |
| 4,791,708 | 12/1988 | Smolens | 24/33 C |
| 4,798,760 | 1/1989 | Diaz-Kotti | 428/234 |
| 4,915,896 | 4/1990 | Rachal | 264/511 |
| 5,137,601 | 8/1992 | Hsu | 162/358.2 |
| 5,422,166 | 6/1995 | Fleischer | 428/193 |
| 5,502,120 | 3/1996 | Bhatt et al. | 525/440 |
| 5,506,033 | 4/1996 | Smith | 428/192 |

*Primary Examiner*—Merrick Dixon
*Attorney, Agent, or Firm*—Cort Flint; Henry S. Jaudon

[57] ABSTRACT

A dryer fabric for use with drying drums in a dryer section of a paper forming machine wherein a plurality of transversely extending filament yarns interconnect a plurality of transversely extending filament yarns to form the dryer fabric as a continuous loop. The dryer fabric is formed with a plurality of silicone strips along its edge portions to prevent wear due to abrasion and heat, the silicone rubber encapsulates end portions and edge ones of the yarns forming beads along the outer surfaces of the dryer fabric which separate the yarns from direct contact with the drums. The dryer fabric is capable of operating at temperatures of between 350° to 500° F. in a paper forming machine without accelerated degradation.

18 Claims, 4 Drawing Sheets

DRYER FABRIC HAVING AN ABRASION RESISTANT EDGE

This is a Continuation-In-Part of U.S. application Ser. No. 08/239,903, U.S. Pat. No. 5,506,033, Jun. 22, 1995, filed May 9, 1994, which is a Continuation-In-Part of U.S. application Ser. No. 08/043,848, filed Apr. 7, 1993 now abandoned.

BACKGROUND OF THE INVENTION

The instant invention is directed to papermaking fabrics for use in papermaking machines consisting of a paper forming section where a wet sheet is formed from a dilute suspension of cellulose fibers in water. The dilute fiber suspension of 0.2 to 1.0% solids is discharged at speeds up to 6000 ft./min. on to a moving forming fabric moving at the fiber discharge speed ±30 ft./min. As water is removed by suction throughout the permeable forming fabric, a paper sheet is formed on the surface of the forming fabric by a process of filtration and reorientation of suspended fibers to a plane parallel with the plane of the forming fabric surface. The consistency is further increased by additional water removal by suction until it reaches a consistency of 20–25% solids.

At that point, the wet paper sheet has sufficient wet strength to be transferred to the press section where the wet paper sheet is further dewatered by pressing the wet sheet between a smooth roll and a woven or needled papermakers wet felt. In the process of pressing, water is transferred from the wet paper sheet to the papermaker's felt, which is so constructed that it retains the necessary void volume under pressure to pass the water expressed from the wet paper sheet.

Through a series of such presses, the wet paper sheet is subject to increasing pressure and the solid content of the paper will increase from 20–25% to 37–45% depending on paper, grade, machine speed and press construction.

With present technology, 47% solids appear to be the maximum solids content in a sheet of paper that can be obtained through pressing.

After the press section, the paper sheet is transferred to the drying section where the rest of the moisture in the pressed sheet of paper is removed by evaporation in the following manner. First, the paper sheet is brought in contact with the hot surface of a series of rotating steam heated cylinders. These dryer fabrics are made from polymeric material and can be either woven fabric, spiral fabric or other fabric construction. These fabrics are made endless by a cross machine direction seam during installation. The edges of the fabric are subject to damage and wear due to contact with stationery machine parts and guide pedals and to deterioration due to hydrolysis due to the extreme heat of the dryer drums. It is therefore imperative that the fabric edges be protected. The subject of this invention is an edge protective silicone coating for a dryer fabric which is degradation resistance due to hydrolysis and also abrasion resistant.

Dryer fabrics are subject to thermal and chemical degradation by hydrolysis on the paper machines. This degradation is produced by the high temperatures of between 320° F. to 350° F. and high humidity of 0.25 to 0.35 lb. of water per pound of dry air to which it is subjected in use. It is essential that the edges i.e. the outer areas between the paper supporting center and the outer edge be separated from direct contact with the heated dryer drums. The material separating the edges must have a resistance to thermal degradation and degradation by hydrolysis that exceeds that of the polymeric material forming the dryer fabric.

It is usual that dryer fabrics have a sealer coating applied to their edges in order to protect them against wear and prevent unraveling. Sealed edges also act to stabilize the entire dryer fabric against yarn shifts which render the drainage channels uneven when the fabric is in use.

The most common coatings employed as an edge seal are polyurethane and epoxies polyurethanes. These materials have the capability of securely adhering to the monofilaments forming the dryer fabric and they possess good degradation resistance to most of the chemicals employed with papermaking machines in the papermaking process. It has been found, however, that these coatings are not sufficiently degradation resistant for use with dryer fabrics formed of polyphenylene sulfide, polypropylene terephtalate and others which have a useful life of between 300 and 400 days on the paper machine.

A second problem with the current coating materials as an edge seal coating is the cost of application. These materials, when applied as a liquid to the fabric edge, require between twenty minutes and twenty four hours to dry completely. The coating process normally takes place on a circular fabric, which is carried by a pair of drive rolls under tension. Due to the drying time required, the coated edges are passed over the rolls in a partially dried state. In this state, the coating material attaches to the drive rolls. The coating material on the rolls tend to stick with the coating on the fabric edges to produce an uneven bead along the fabric edge. Eventually these attached coatings lead to degradation of the edge seal.

To eliminate this attaching, the drive rolls must be covered with tape at the edge portions of the fabric. The tape is of a material to which the coating material does not readily adhere. This process improves the procedure, but eventually the coating material builds up and the above problems are encountered.

It has not been previously recognized that the fabric area between the edge seal and the paper supporting area, when protected from abrasion and heat by separating and abrasion resistant strips becomes more stable and wear free thus increasing the life of the fabric. This area assists in drainage and therefore must retain its porosity.

Numerous attempts have been made to find a more satisfactory edge seal coating as indicated by the below referred to U.S. Patents.

U.S. Pat. No. 2,718,791 to Hose et al show one such attempt. Here, the edge portions of a Fourdrinier belt are coated with a polyethylene material which is flexible and elastic. Polyethylene degrades at around 300° F.

U.S. Pat. No. 3,523,867 to MacBean discloses a sealed coated edge for a paper forming fabric similar to the Hose et al patent. MacBean employs nylon, polyethylene or polyvinylchloride as the coating material. The fabric of this patent encounters similar problems to those discussed above.

U.S. Pat. No. 3,652,390 to Peterson is also directed to an edge seal coating for a paper forming fabric. Here the edges are coated with polyethylene or rubber.

Attempts have been made to eliminate edge wear of papermaking fabrics. One such attempt is taught in the arrangement of U.S. Pat. No. 4,917,937 where molten plastic is applied to the surface of the forming fabric as a plurality of configured rows of plastic material. This patent does not disclose a particular plastic nor does it disclose having the plastic forced into the interstices of the forming fabric to bond with the internal warp and weft yarns constituting the forming fabric.

U.S. Pat. No. 5,084,326 is also directed to providing abrasive resistant areas adjacent opposed edges of a forming fabric. The '326 patent discloses applying strips of abrasion resistant plastic material incorporated with a melting adhesive to opposed edges of the forming fabric in various spaced patterns. The abrasive material only partially penetrates the forming fabric and is secured thereto by the adhesive incorporated therewith. The abrasion resistant material which is a polyester or polyamide mixed with a melting adhesive may be in the form of threads or particles.

U.S. Pat. No. 5,422,166 is directed to a paper forming fabric for us in the forming section of a papermaking machine. The fabric is formed with abrasion resistant edges formed to include polyurethane strips.

German Patent application (DE-052922025) is directed to almost the same subject matter as the '326 patent referred to above. Here a paper forming fabric has wear resistant areas formed by applying a wear resistant plastic or polymer at wear areas. The materials disclosed are polyamide and polyester; no polyurethanes. The reference discloses the use of formaldehyde resin which acts with the above plastics as an adhesion promoter.

None of the patents discussed provide a solution for the deficiencies as set forth above.

Accordingly, it is an object of the invention to provide a stable coil constructed or woven dryer fabric for paper forming machines.

Another object of the invention is to provide a dryer fabric capable of operating at temperatures of between 320° and 350° F. without its edges suffering from degradation due to wear or hydrolysis.

Another object of the invention is to provide an edge seal coating which protects the fabric forming yarns at the fabric edge portions which do not support the paper being formed to prevent wear and maintains stability.

The instant invention has as its object to provide a dryer fabric for a papermaker's machine having abrasion and degradation resistant zones along longitudinal edge portions of the fabric.

Another object of the invention is to provide a dryer fabric with abrasion and degradation resistant areas and yet have substantially undiminished dewatering properties.

Another object of the invention is to provide a dryer fabric having abrasion resistant areas capable of withstanding the temperatures and operational speeds at which the fabric must function.

Another object of the invention is to provide edge wear resistant strips which result in a more cost efficient dryer fabric.

Another object of the invention is to provide a polymer paste which may be polymerized into a non-tacky condition immediately after application to the edge portions of a dryer fabric.

SUMMARY OF THE INVENTION

The invention relates to dryer fabrics which are capable of operating at temperatures of between 320° and 350° F. in a dryer section of a papermaking machine. The fabric may be woven or of coil construction. The forming yarns are preferably monofilament or alternatively multifilament or a combination. The yarns are preferably formed of polyaryletherketone polymers PEEK, polyphenylene sulfide, RYTON, or other similar heat resistant, moisture resistant filaments. The edge area of the yarns may be fused together and the dryer fabric is preferably formed as a continuous loop having a support surface and a running surface.

An edge coating preferably of a non-flowing U.V. silicone paste is adhered to and along each of the edge portions to include fabric strips adjacent thereto. The U.V. silicone coating forms a plurality of continuous beads along both the support surface and the running surface. It also extends through the interstices of the dryer fabric to unite the forming filaments along the edge portions. This arrangement produces a stable dryer fabric in which the edge portions are protected from wear and degradation.

The U.V. silicone paste comprises a mixture of polydimethylsiloxane, modified silicon dioxide, and ethyltriacetoxysilane which is commercially sold as NUVA-SIL 83 U.V. curing silicone. This silicone paste has the capacity to be polymerized into a solid non-tacky substance immediately after application by the radiation of an ultra violet light.

The continuous fabric may be heat set at between 400° and 500° F. prior to applying said coating. To apply the coating, the continuous fabric is tensioned between the drive rolls until it is taught. The fabric is then rotated about the drive rolls at between 6 and 12 meters per minute and the U.V. silicone paste is applied under pressure of between 50 and 150 PSI simultaneously to both the upper and the lower edge surfaces of the continuous fabric to form beads on each of these surfaces which extend along the length of the fabric. The silicone paste completely fills the interstices of the fabric between the opposing fabric surface.

The coated dryer fabric is passed immediately through ultra violet light of between 250 and 350 watts per inch. The ultra violet light acts to dry the U.V. silicone paste substantially instantaneously while the fabric is still between the drive rolls.

Prior to coating, the edge portions of the continuous fabric are cut to form the fabric to a desired width with heat cutters which also act to melt bond the coils and pintles together at the point of cutting.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
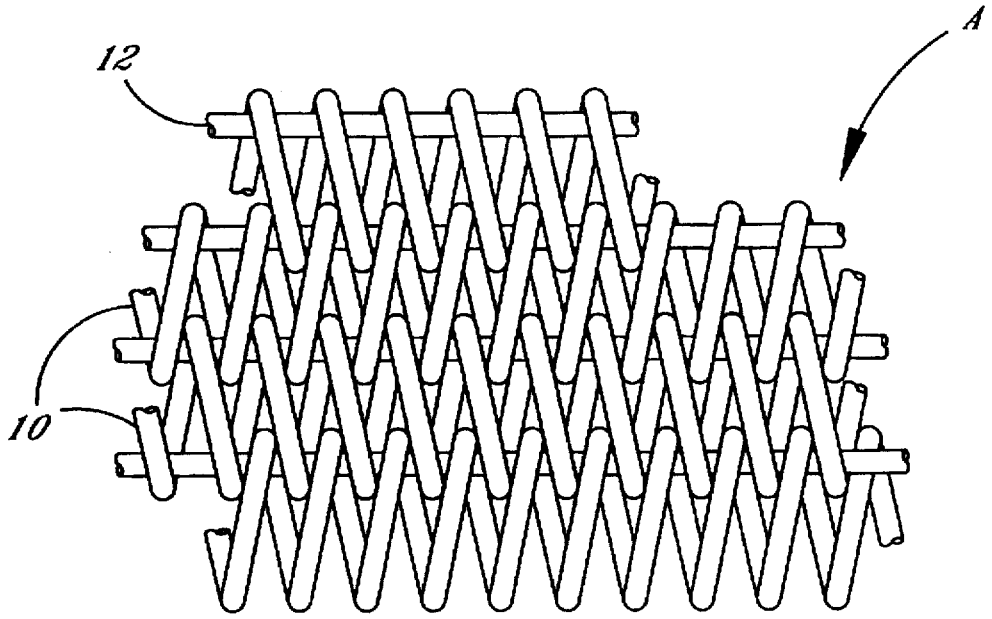
FIG. 2 is a sectional top view of a dryer fabric construction which may be incorporated in the invention.
Figure 3:
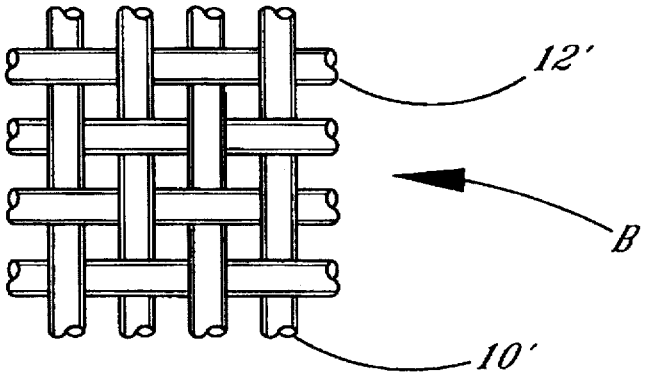
FIG. 3 is a sectional top view of an alternative dryer fabric construction which may by incorporated in the invention.
Figure 6:
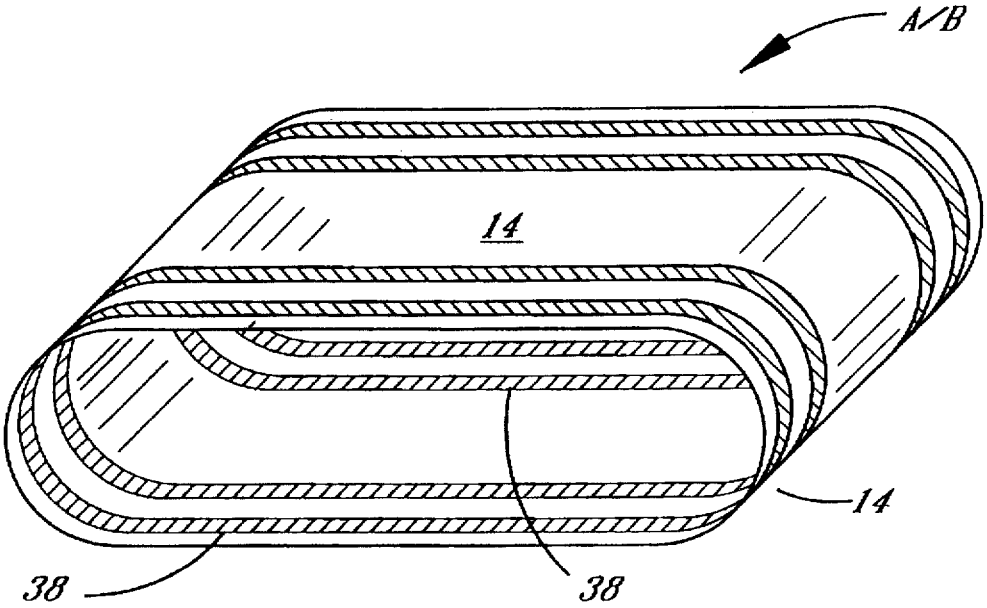
FIG. 6 is a perspective view of an embodiment of the dryer fabric of the invention showing the protective strips arranged parallel.
Figure 7:
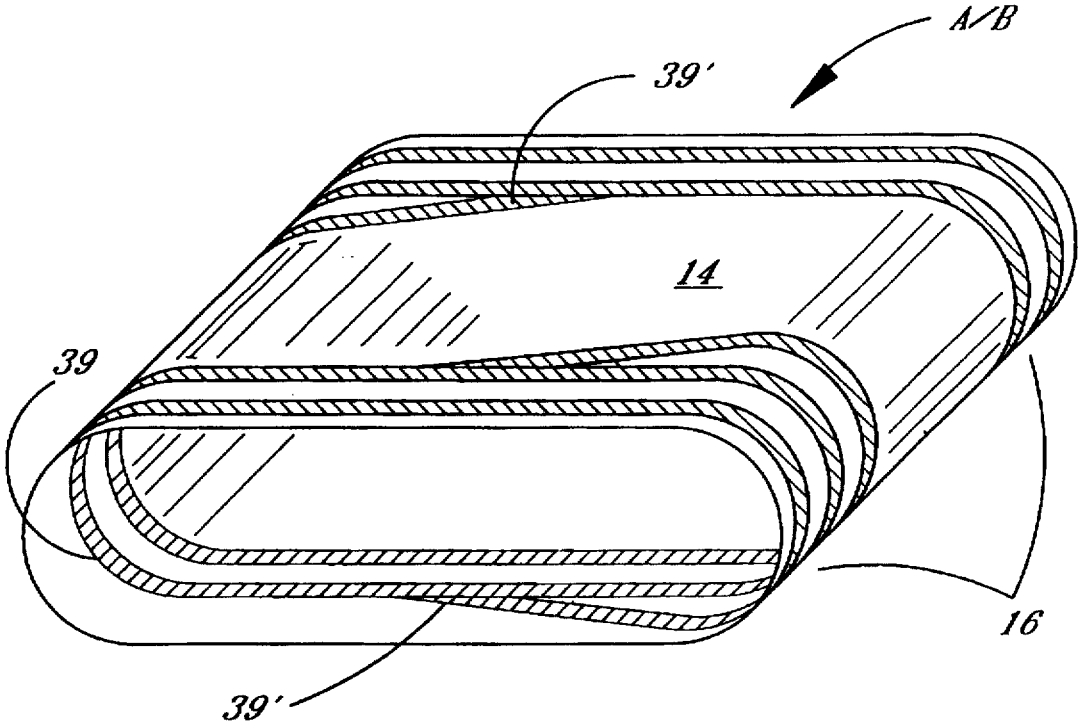
FIG. 7 is a perspective view of the second embodiment showing the strips in spiral form.

Turning now to the drawings, FIG. 2 shows in detail the structure of dryer fabric A which is formed of coils, which form the longitudinal extension of the fabric and are comprised of monofilaments 10. Monofilaments 10 are interconnected by transversely extending filaments 12. FIG. 3 shows an alternative arrangement in which dryer fabric B is of woven construction with the transversely extending yarns comprising weft filaments 12' which are interwoven with the longitudinally extending warp filaments 10'. Dryer fabrics A and B are constructed as a continuous loop as shown in FIGS. 6 and 7. The fabric forming filaments are preferably formed of heat resistant polyaryletherketone polymers (PEEK) or polyphenylene sulfide such as RYTON. The forming filaments may be monofilaments which may be circular or rectangular in cross-section. The circular monofilaments have a major axis measurement of between 0.3 mm to 1.3 mm. The rectangular monofilaments have a flatness ratio of between 1.1:1 and 2.5:1.

Modern dryer sections operate at temperatures of between 320° F. and 350° F. These fabrics have a permeability factor of between 600 and 1000 CFM. During operation, the water content of the paper slurry is reduced from 50% to 60% to approximately 2% in a very short time over a limited area. Because of the limited area and high temperatures there is a large build up of steam and humidity; between 0.25 and 0.35 lb. of water per pound of dry air. This necessitates that the dryer fabric, to include its protective edge coating, must have a high hydrolysis resistance and chemical resistance in order that it may possess satisfactory degradation properties.

It is extremely important that dryer fabrics be stable in operation. It is necessary that the forming filaments not shift and that the edges not fray or unravel. To this end transverse filaments 12, 12' may be crimped at the points where longitudinal filaments 10, 10' engage therewith. This structure is described in more detail in U.S. Pat. No. 5,104,724, the disclosure of which is incorporated herewith. It is also usual that the edge structures are sealed, as shown at 17 in FIGS. 4 and 5, by cutting the fabric to width with a heat cutter. This cutting apparatus causes the end portion of the transverse filaments 12, 12' to fuse with longitudinal filaments 10, 10' where they contact. It is also usual to further stabilize the drying fabrics by applying an edge seal which consist of coating the edge portions with a synthetic material. The usual synthetic material is a polyester resin.

For modern dryer fabrics this structure presents two major obstacles. Primarily, the usual edge coatings such as polyesters and epoxy polyurethanes begin to degrade at temperatures of around 300° F. Due to the high operating temperatures of the modern dryer machines, as already discussed, these coatings degrade quickly and the fabric is rendered unstable and must be replaced.

Another obstacle for modern dryer fabrics is degradation of edge forming yarns, i.e. end portions of the transverse yarns and those edge portions or ones of the longitudinally extending yarns. This degradation is primarily caused by the edge portions adjacent the paper supporting areas coming into contact with the drying drums during drying. Because the paper insulates the paper supporting areas from the drum, this area is not subjected to excessive deterioration.

A second drawback of forming abrasion resistant edge seals is the drying time of the sealant. Known polyurethanes and epoxy polyurethanes require approximately twenty minutes to dry. As the coatings are applied to endless fabrics passing over support rolls, the un-dried sealant attaches to the rolls. As the sealant paste builds upon the rolls, it tends to disrupt the uniformity of the coating applied to the edges to the point than it tends to pull the coating from the fabric. This produces an uneven edge seal and in some instances an unstable edge seal. In order to alleviate this problem the rolls must be covered with a material, usually paper, which does not readily adhere with the coating material. This is a labor intensive and time consuming operation. Also, it is only a temporary solution as the sealant eventually builds up on the paper and the above referred to problems are incurred.

A previously unused coating sealant in papermaking, i.e., silicone rubber, has been found to be extremely satisfactory. This sealant, when dried, retains its flexibility, possesses satisfactory abrasion resistance does not appreciably degrade when subjected to the chemicals (principally chlorine) used in papermaking and functions in a temperature range of between −85° and 400° F. Silicone rubber sealants have been found to adhere with synthetic materials such as those formed of PEEK and RYTON.

There are three basic categories of silicone rubber sealants available. They may be categorized by the manner in which they are cured.

The most commonly available types of silicone rubber sealant are those which are cured by exposure to atmospheric moisture or to air. They are cured by irradiation. One such silicone rubber sealant is RTV Sealant 732 manufactured by Dow Corning. This sealant requires at least five minutes to skin over and at least twenty four hours to completely cure.

Another type of silicone rubber sealant is cured by exposure to heat. Such a sealant is applied in paste form and then is cured by the application of heat. Again the curing time is several minutes. Also, the heating process could effect the heat set of a heat set fabric to which this sealant is applied.

Basic ingredients for these type of silicone rubber sealants are silica, amorphous, fumed, methyltriacetoxysilane, ethyltriacetoxysilane, dimethylsiloxane and hydroxy terminated. Neither of these categories of sealants, when used as an edge covering for paper making fabrics, eliminate the problem of build-up on the rolls supporting the continuous paper forming fabric during its application onto the fabric edges.

A third category of silicone rubber sealant is one which cures when subjected to ultra violet radiation. This silicone sealant is described as an ultra violet curable silicone, a UV/ACETOXY Curing Silicone or a UV SILICONE sealant. To date, there is only one known manufacturer of such a silicone sealant and that is the Loctite Corporation of Newington Connecticut. The product is sold under the name NUVA-SIL 83 and is described as a U.V. CURING silicone sealant. This U.V. CURING silicone sealant possesses cure properties which when subject to ultra violet radiation of between 75 and 250 mW/cm$^2$, becomes completely tack-free in less than two seconds.

NUVA-SIL 83 silicone coating, when applied to the edges of a dryer fabric, does not decompose when subjected to the operating temperatures of the modern dryer machines. Also, the edge seal fully adheres with the fabric and is completely dried prior to reaching the down stream support roll and the bead of the seal is uniform throughout its length.

NUVA-SIL 83 includes between 60 and 65% Poly (dimethylsiloxane) hydroxy terminated, between 20–25% modified silicone dioxide, between 5 and 10% poly (dimethylsiloxane) Dimethyl polysilosiloxane and between 3–5% modified triacetoxysilane. Lesser amounts of photoinitiator (1–3%) and Ethyetriacetoxysilane, Methyltriacetoxysilane, and Dibutyltin dilaurate (0.1–1%) may be included.

The term U.V. Silicone rubber, paste or sealant is herein defined as describing a silicone sealant which is formulated to cure when subjected to a prescribed level of ultra violet radiation.

The U.V. Silicone paste is applied at room temperature to the edge portions of fabric A/B as described in the parent application.

As fabric A emerges from the coating heads it is immediately passed beneath a dryer. The dryer preferably consists of a plurality of ultra violet lamps arranged in two banks and located at between 4 and 6 inches above and below edges 16 of dryer fabric A.

Each ultra violet lamp delivers approximately 300 watts per inch.

The fabric is carried by drive rolls at a rate of between 6 and 12 meters per minute through the coating apparatus and the drying apparatus so that the U.V. Silicone paste is completely dry prior to the fabric reaching a down stream drive roll.

In alternative arrangements, the dryer fabric could be constructed as a woven double or triple layer fabric with the warp and/or weft being formed of mono or multi filament yarns extruded from PEEK, RYTON, or other similar heat resistant materials. The dryer fabric may be woven endless or made endless after weaving.

Figure 1:
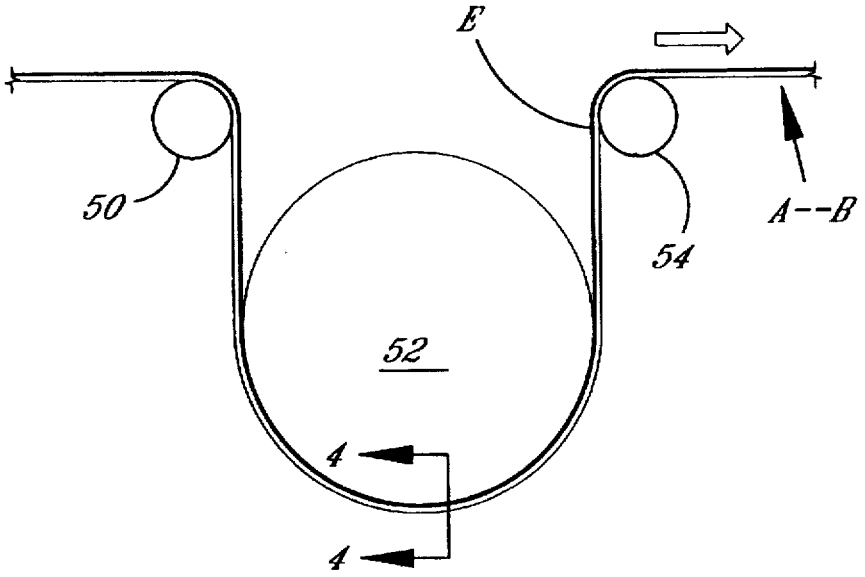
FIG. 1 is a diagrammatical sectional side view of the dryer fabric of the invention passing around a dryer drum.

Referring now to FIG. 1, dryer fabric A/B is shown passing over idler roll 50 beneath heated drying drum 52 and back up and over idler roll 54. Paper E is shown resting on the support surface of dryer fabric A/B where it is pressed against the outer surface of the drying drum.

Figure 4:
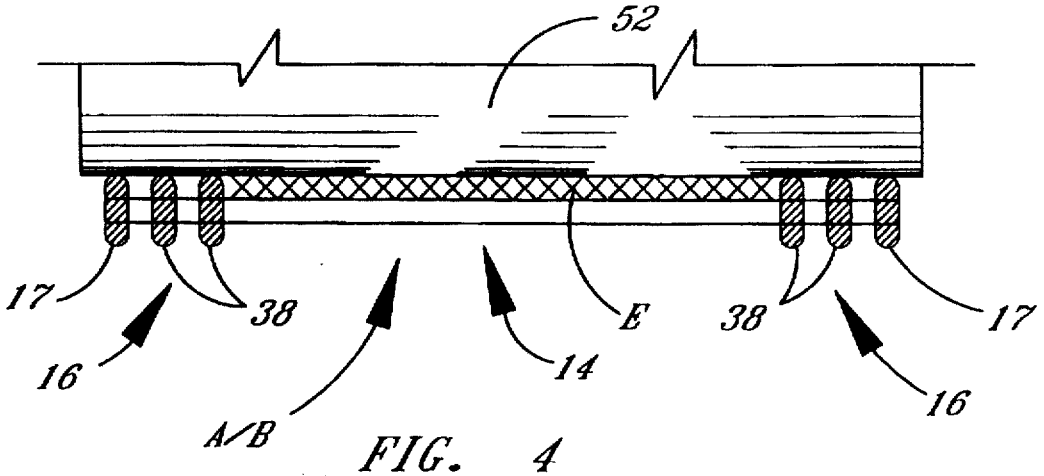
FIG. 4 is a sectional view taken along lines 4—4 of FIG. 1 showing the relationship of the dryer fabric and the dryer drum.
Figure 5:
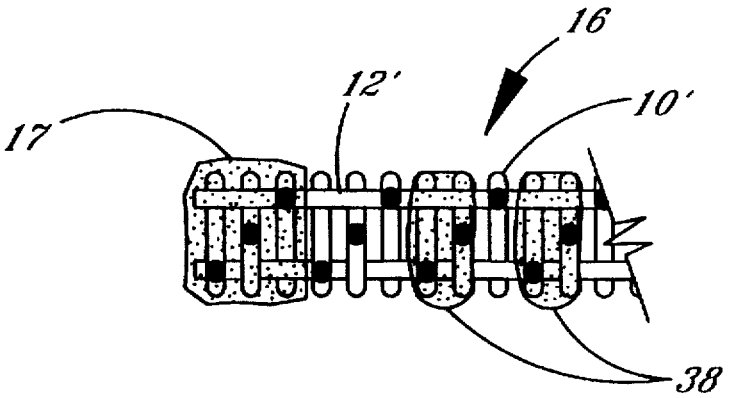
FIG. 5 is a detailed sectional end view showing the edge structure of the dryer fabric.

Referring now to FIGS. 4, 5, and 6 forming fabric A/B is shown continuous with filaments 10/10' running in the machine direction and filaments 12/12' running transverse of the fabric. Filaments 10/10' and 12/12' are interlaced in a suitable manner such as a woven pattern or a interconnected coil pattern as shown in FIGS. 2 and 3 to form fabric A/B. As can best be seen in FIGS. 4 and 5, outer edges of fabric A/B are preferably finished with an edge seal 17 of silicone coating which acts to resist abrasion and also acts to stabilize the edge structure of the forming fabric. Alternatively, the edge may simply be finished with a heat seal. The longitudinal area adjacent each edge 16 of fabric A/B is coated with at least a pair of abrasion and hydrolysis resistant silicone strips 38, however, as many as seven abrasion and hydrolysis resistant silicone strips 38 may be desirable. Abrasion and hydrolysis resistant silicone strips 38 may be arranged parallel with opposed edges of fabric A/B and are also arranged to be parallel with the paper supporting area 14; see FIG. 6. Strips 38 completely encircle fabric A/B so that their starting points abut with their ending points.

As best shown in FIGS. 4 and 5, abrasion and hydrolysis resistant silicone strips 38 extend outwardly above the paper support surface 14 forming contact areas with heating drum 50. The strips 38 form beads which extend above surface 14 by between 1/16" and 1/4". Strips 38 also may form beads which extend below the support surface of dryer fabric A/B as shown. The abrasion resisting silicone material is integrated into the interstices of fabric A/B so as to bond with and about filaments 10/10' and 12/12'. The strips of abrasion and hydrolysis resistant silicone are laterally spaced and in some instance longitudinally to allow proper drainage along the edges of the dryer fabric. As can best be seen in FIG. 4, strips 38 maintain edges 16 spaced from drum 50 preventing contact of filaments 10/10' and 12/12' therewith. Also, paper E being dried separates the paper supporting area 14 dryer fabric A/B from direct contact with the drum. By maintaining the forming filaments insulated from the extreme heat of drum 54 deterioration of the forming filaments by hydrolysis is slowed and the life of the fabric is prolonged.

Figure 8:
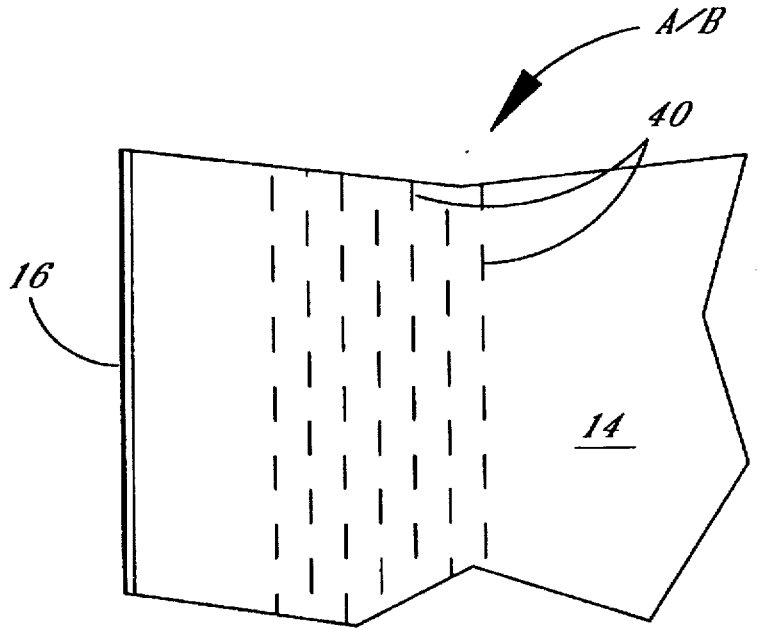
FIG. 8 is a top view of a third embodiment showing the strips as being interrupted along their length.
Figure 9:
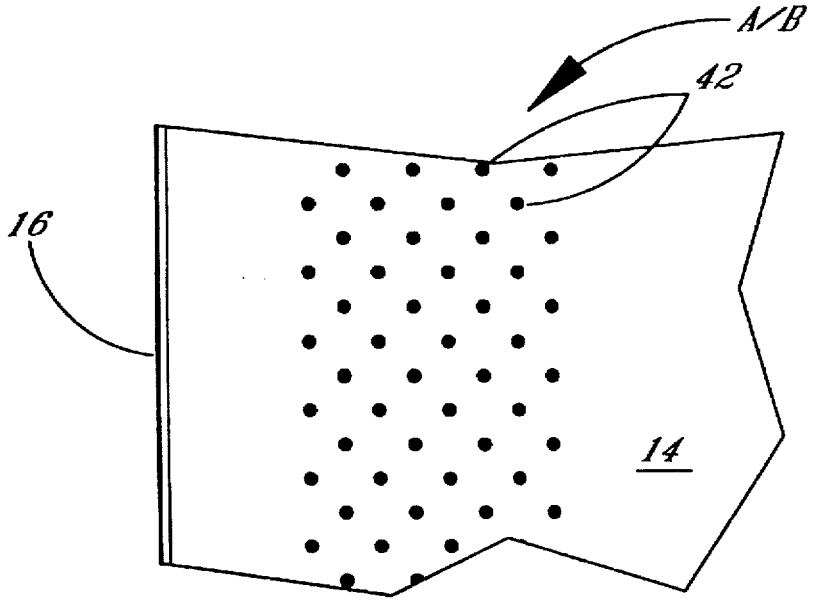
FIG. 9 is a top view showing a fourth embodiment in which the strips are arranged as dots.

Other arrangements of the hydrolysis and abrasion resistant strips are shown in FIGS. 7, 8, and 9. Referring now to FIG. 7, dryer fabric A/B is provided with a continuous abrasion resistant and hydrolysis strip 39 which is incorporated with fabric A as a continuous coil. Starting and stopping ends 39' of the coil are gradually merged with the adjacent strip as shown in the drawing.

FIG. 8 shows an alternative arrangement in which the abrasion and hydrolysis resistant strips consist of a plurality of interrupted strips 40 arranged in parallel rows.

FIG. 9 shows yet another arrangement where the abrasion and hydrolysis resistant strips comprise a plurality of parallel rows of dots 42.

While a preferred embodiment of the invention has been described using specific terms, such description is for illustrative purposes only, and it is to be understood that changes and variations may be made without departing from the spirit or scope of the following claims.

What is claimed is:

1. A dryer fabric for use with at least one heated drying drum in a paper making machine said dryer fabric being formed of continuous filament yarns to have a support surface and a running surface including:

a pair of unfinished edges extending along the length of said dryer fabric;

a paper supporting area extending over a major portion of said support surface between said edges and along the length of said dryer fabric;

abrasion and hydrolysis resistant areas extending along the length of said dryer fabric adjacent outer edges of said supporting area and respective of said opposed edges;

abrasion and hydrolysis resisting material covering portions of said abrasion and hydrolysis resistant areas of said running surface forming drum contact areas above said support surface said abrasion and hydrolysis resisting material comprising a fast curving silicone sealant impregnated into the interstices of said drying fabric and bonded about said edge forming filaments; whereby in use, said dryer fabric is maintained separated from said drying drum in said paper supporting area by paper carried on said paper supporting area and in said abrasion and hydrolysis resisting areas by said silicone sealant.

2. The dryer fabric of claim 1 wherein said unfinished edges are impregnated with said silicone sealant coating to stabilize said edges.

3. The dryer fabric of claim 1 wherein said dryer fabric is single ply.

4. The forming fabric of claim 1 wherein said dryer fabric is at least two ply.

5. The dryer fabric of claim 1 wherein said silicone sealant is arranged as a plurality of continuous strips arranged in substantially parallel rows.

6. The dryer fabric of claim 1 wherein said silicone sealant is arranged as a single strip arranged in a plurality of spirals.

7. The dryer fabric 1 wherein said silicone sealant is arranged as a plurality of interrupted strips extending along the length of said fabric.

8. The dryer fabric of claim 1 wherein said silicone sealant is arranged as a plurality of polyurethane circular dots arranged along the length of said fabric.

9. The dryer fabric of claim 1 wherein said continuous filaments are selected from the group consisting of monofilament nylon, monofilament nylon polyester blend, monofilament polyester fluorocarbon blend, polyaryletherketone and polyphenylene sulfide.

10. The dryer fabric of claim 1 wherein said silicone sealant appears on both said support surface and said running surface areas.

11. The dryer fabric of claim 1 wherein said silicone sealant passes completely through said dryer fabric and bonds about said edge forming filaments.

12. A dryer fabric capable of operating with drying drums heated to temperatures of between 320° and 350° F. in a dryer section of a papermaking machine; wherein, a plurality of longitudinally extending filament yarns are interconnected with a plurality of transversely extending filament yarns to form said dryer fabric as a continuous loop having a support surface and a running surface;

said support surface including a paper supporting area arranged between opposed edge portions, said supporting area being adapted to carry and press paper into contact with said drying drums;

said dryer fabric having a plurality of continuous abrasion resistant and hydrolysis resistant strips formed along said opposed edge portions adjacent said supporting surface, said strips comprising a U.V. silicone sealant adhered along each said edge portion, said strips of U.V. silicone sealant forming a coating comprising continuous and uniform beads along said support surface and said running surface which extend through interstices of said dryer fabric to unite edge ones of said longitudinally extending yarns with end portions of said transversely extending yarns to seal said edge portions, said beads extending along a plane above the plane of said support surface, said beads function to protect said edge yarns from deterioration due to friction and hydrolysis by maintaining said edge portions separated from contact with said dryer drums during drying.

13. The fabric of claim 12 wherein said U.V. silicone comprises between 60% and 65% polydimethylsiloxane and between 20% and 25% modified silicone dioxide.

14. The fabric of claim 12 wherein said U.V. silicone strips cover upper and lower surfaces of said edge portions of said dryer fabric.

15. The fabric of claim 12 wherein said U.V. silicone strips comprise a single strip formed in a plurality of spirals along each of said edges.

16. The fabric of claim 12 wherein said U.V. silicone strips comprise a plurality of interrupted longitudinally extending strips extending along said edges.

17. The fabric of claim 1 wherein said continuous filament yarns comprise a plurality of helical coils laid across said fabric with the coil elements extending longitudinally of said fabric, said coils being interconnected by transverse filaments to form a continuous dryer fabric.

18. The fabric of claim 1 wherein said continuous filament yarns comprise longitudinally extending warp yarns interlaced with transversely extending weft yarns.

* * * * *